United States Patent [19]

Colonna

[11] Patent Number: 4,934,738

[45] Date of Patent: Jun. 19, 1990

[54] COMBINED DOCUMENT BINDER AND COVER HOLDER

[76] Inventor: Ralph Colonna, 1335 Main St., St. Helena, Calif. 94574

[21] Appl. No.: 331,167

[22] Filed: Mar. 31, 1989

[51] Int. Cl.[5] ..... B42D 3/00; B42F 9/00

[52] U.S. Cl. ..... 281/28; 281/45; 281/21.1; 281/29; 402/73

[58] Field of Search ..... 281/21.1, 28, 29, 45, 281/46; 24/67 R, 67 B, 67.9; 402/73, 74, 78

[56] References Cited

U.S. PATENT DOCUMENTS

| | | | |
|---|---|---|---|
| 362,754 | 5/1887 | Love | 281/21.1 |
| 500,833 | 7/1893 | Wolfard | 281/45 |
| 1,197,314 | 9/1916 | Wells | 281/45 |
| 3,092,400 | 6/1963 | Smith | 402/73 |
| 3,212,505 | 10/1965 | Toman | 281/21.1 |
| 4,351,546 | 9/1982 | Cognata | 281/45 |
| 4,486,032 | 12/1984 | Leahy | 281/45 |
| 4,569,613 | 2/1986 | Thomas | 281/45 |
| 4,706,994 | 11/1987 | Lockhart | 281/29 |

FOREIGN PATENT DOCUMENTS 650656 8/1985 Switzerland .

OTHER PUBLICATIONS

P.C.T. WO85/01760, Nyberg, NIP Means, Particularly Clothes Pin, Apr. 25, 1985.

*Primary Examiner*—Paul A. Bell
*Assistant Examiner*—Hwei-Siu Payer
*Attorney, Agent, or Firm*—Kolisch, Hartwell & Dickinson

[57] ABSTRACT

A combination document binder and cover holder is provided in a single article. The binder and cover holder is in the form of an elongated, generally channel-shaped body, preferable made from a resilient plastic material. The body includes two parallel strips joined along one edge to form a spine. At the opposite edge the two strips are adjacent to one another and form an elongated narrow opening. The open side of the "U" is where sheets of paper are inserted and gripped together by the binder. Two branch strips are attached to the binder on the outside of the U-shaped channel. Each branch strip is attached to the binder along one side of the channel opening, at a point near the opening, and extends back toward the spine generally parallel to the binder. Cover sheets can be inserted between the branch strips and the binder and folded over the binder and sheets held in the binder to create a complete, bound package.

7 Claims, 1 Drawing Sheet

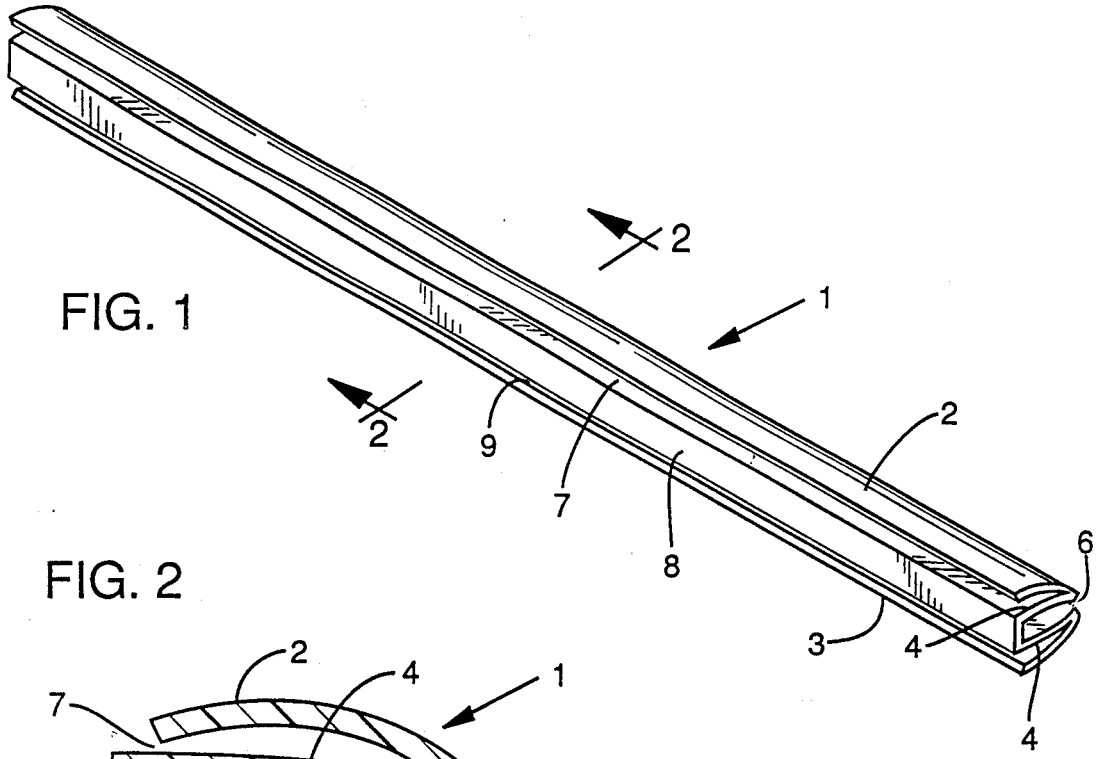
FIG. 1
FIG. 2
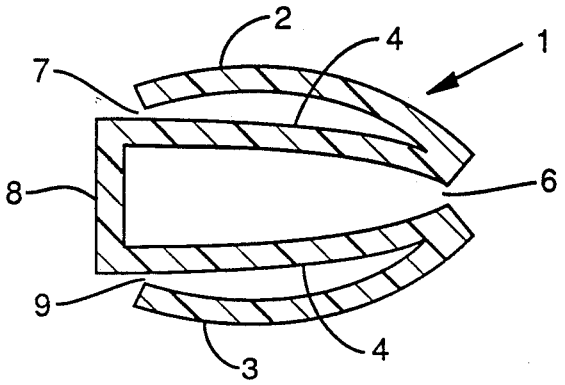
FIG. 3
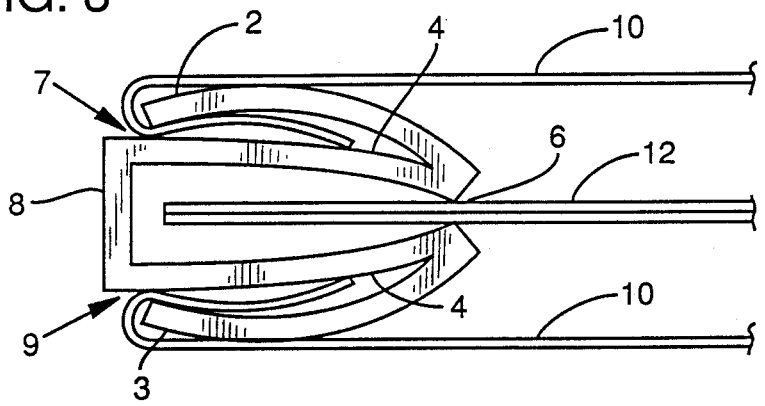

COMBINED DOCUMENT BINDER AND COVER HOLDER

BACKGROUND OF THE INVENTION

This invention relates generally to document binders of the type which hold multiple sheets of paper together along one edge.

One-piece binders are known which are capable of gripping and holding multiple sheets of paper along one edge by means of an elongated, channel-shaped device. If a user desires to install cover sheets on a document bound together by such a prior art device, it is necessary to put the cover sheets between the gripping sides of the device, together with the bound sheets of paper. Such a system for installing covers on a document bound with a channel-type binder is functional, but unesthetic. Such prior-art channel-type binders offer no convenient alternative for installation of document covers which would improve the appearance of the final bound document. Attachment of a cover over the binder would require the use of adhesives, tape or the like, which is both inconvenient and might detract from the final appearance of the binding.

It would be advantageous to have a simple, inexpensive system for binding sheets of paper together which also includes a means for conveniently attaching and holding cover sheets for the document, cover sheets which mask the binding itself and present a final appearance similar to the spine of a book.

It would also be advantageous to provide such a binding system from a single piece of extrudable plastic material.

SUMMARY OF THE INVENTION

The invention provides a combination document binder and cover holder. It comprises an elongated, generally channel-shaped body formed of an elastically resilient material. The body is formed to include two strip members extending generally parallel to one another joined together lengthwise along a spine which extends along a first side of the body of said binder. The spine and the two strip members together form the closed sides of a generally U-shaped channel extending the length of the binder. At the open end of the U-shaped channel, the strip members extend adjacent to one another along a second side of the body of the binder to form a narrow binder opening for receiving one or a plurality of sheets of paper or other sheet material to be bound together Also extending from the binder opening, on the outside of the U-shaped channel, are first and second branch members which are elongated strips similar to, although preferably slightly narrower than, the strip members joined by the spine. The first branch member is attached to one strip member lengthwise adjacent the binder opening and extends toward the spine, generally parallel to the strip member. The second branch member is attached to the other strip member lengthwise adjacent the binder opening and extends toward the spine, generally parallel to the strip member. Each branch member terminates adjacent to its respective strip member near the spine.

Covers are attached to the binder and cover holder of the present invention by inserting one cover sheet between the first branch member and the one strip member and a second cover sheet between the second branch member and the other strip member. The slits or openings into which the cover sheets are inserted open or face in the direction opposite to that of the binder opening. Cover sheets are inserted in their respective openings and folded back over the binder to cover the bound document. It is preferable to use cover sheets of a greater width than the bound sheets, to embrace the entire bound document and provide a pleasing appearance. In the preferred embodiment, the binder and cover holder is formed by extrusion as a unitary piece of plastic material.

BRIEF DESCRIPTION OF THE DRAWINGS

FIG. 1 is a plan, perspective view of a document binder and cover holder in accordance with the present invention.

FIG. 2 is an enlarged, cross-sectional view of the document binder and cover holder of FIG. 1, taken along line 2—2 of FIG. 1.

FIG. 3 is an enlarged end view of the document binder and cover holder of FIG. 1, illustrating the use of the present invention.

DETAILED DESCRIPTION OF THE PREFERRED EMBODIMENT

Referring to FIGS. 1 and 2, the document binder and cover holder of the present invention is preferably a body 1 formed of a resilient plastic material such as polycarbonate. Body 1 is in the form of an elongated, generally channel-shaped clip or gripping means, as described below. The shape of body 1 is derived from a series of elongated strips of the plastic material from which the body is made joined together to form the crosssectional shape illustrated in FIGS. 2 and 3. The strips, at 2, 3 and 4 in FIG. 2, include inner strip members 4, which are joined together lengthwise along a first side (the left side, as shown in FIG. 2) by a spine 8. Together, the inner strips 4 and spine 8 form a generally U-shaped channel extending lengthwise along the length of the body of binder 1 and define an elongated, narrow binder opening 6 opening along the open side of the U-shaped channel.

Overlying strip members 4, on the outside of the U-shaped channel formed by the strip members and spine 8, are first and second branch members 2 and 3, respectively. Branch members 2 and 3 are elongated strips of the material from which body 1 is made and are preferably slightly narrower than strip members 4. The branch members extend lengthwise along the outside of the U-shaped channel formed by strip members 4 and spine 8, overlying and extending generally parallel to the strip members. The first branch member 2 is attached to one of the strip members 4 (the top strip member as shown in FIGS. 2 and 3) lengthwise adjacent binder opening 6 and extends toward spine 8. The second branch member 3 is attached to the other strip member lengthwise adjacent opening 6 and also extends toward spine 8 on the opposite side of body 1 from first branch member 2.

Each branch member 2 and 3 extends generally parallel to and terminates adjacent to the strip member to which it is attached. As such, each branch member defines an elongated, narrow opening adjacent spine 8 called a cover opening. First cover opening 7 is formed between the first branch member 2 the strip member 4 to which it is attached and second cover opening 9 is formed between the second branch member 3 and the other strip member 4.

The combination document binder and cover holder described above can be made as a unitary, extruded body. In its final form it has a single elongated opening 6 in the middle of one side and two elongated openings 7 and 9 adjacent the corners of the other side. With reference to FIG. 3, the device is used to bind multiple layers of paper or other sheet material 12 by inserting the sheets into binder opening 6. Because strip members 4 taper toward one another from spine 8 to opening 6 and extend adjacent to one another along the binder opening, they from an elongated clip-type device which grips and holds either one sheet or multiple sheets of paper along the edge of the paper within opening 6, as shown at 12 in FIG. 3. The plastic or other elastically resilient material from which binder 1 is made should be sufficiently resilient to permit opening 6 to yield and open to receive sheets of paper 12 (generally up to a maximum of approximately 40 sheets) but also be rigid enough to hold the sheets in the grip of the device.

Another function of the combination document binder and cover holder is to secure and hold the cover sheets of a bound document to form an attractive and complete package. FIG. 3 illustrates how cover sheets 10 are used with binder 1. A sheet of material such as cover paper 10 is inserted into opening 7 between first branch member 2 and the adjacent strip member 4 and folded back over the binder 1 and document to form the top cover. Another cover sheet 10 is inserted into opening 9 between second branch member 3 and its adjacent strip member 4 and is also folded back over the binder 1 and document to form the bottom cover. The cover sheets 10 will preferably be of greater width than the sheets of paper 12 bound together by binder 1 to allow for insertion into cover openings 7 and 9, leaving sufficient cover material to cover the bound document after being folded over.

The combination document binder and cover holder of the present invention is simple to use, can be manufactured as a single piece of extrudable plastic material and, as such, is inexpensive to make. It creates an attractive and durable document binding and is reusable. It provides a system for binding sheets of paper together and for conveniently attaching and holding cover sheets for the document. The cover sheets both cover the document and mask the binder itself, presenting a final appearance similar to the spine of a book. It can be made in any length to accommodate paper of different sizes.

What is claimed is:

1. A document binder comprising: an elongated, unitary, generally channel-shaped body formed of an elastically resilient material, said body including two strip members extending generally parallel to one another, and a spine joining said strip members together lengthwise along a first side of said body to form the closed side of a generally U-shaped channel, said strip members extending adjacent to one another along a second side of said body to form an elongated, narrow binder opening along the open side of said generally U-shaped channel such that sheet material inserted into said binder opening is gripped and held between said strip members within said binder opening to bind together multiple sheets of the sheet material, said unitary body also including first and second branch members formed on said body extending lengthwise along the outside of said generally U-shaped channel overlying said strip members, said first branch member being attached to one said strip member lengthwise adjacent said binder opening, said first branch member extending toward said spine in a direction generally parallel to said one strip member and terminating near said spine to form a first elongate, narrow cover opening adjacent said spine which opens in a direction opposite to said binder opening and said second branch member being attached to the other of said strip members lengthwise adjacent said binder opening and extending toward said spine in a direction generally parallel to said other strip member and terminating near said spine to form a second elongate, narrow cover opening adjacent said spine which opens in a direction opposite to said binder opening, whereby said first and second cover openings grip and hold cover sheets which are folded over the document binder and sheet material.

2. A document binder as in claim 1 in which said elongated, unitary, generally channel-shaped body is formed of extrudable material.

3. A document binder as in claim 1 in which said elongated, unitary, generally channel-shaped body is formed of plastic.

4. A document binder as in claim 1 in which said elongated, unitary, generally channel-shaped body is formed from a single piece of extrudable plastic material.

5. A document binder as in claim 1 in which the width of each said strip members, between said spine and said binder opening, is slightly greater than the width of said first and second branch members which extend generally parallel to said strip members such that cover material inserted in said first and second cover openings, when folded over the document binder and sheet material, presents an appearance similar to the spine of a book.

6. A document binder comprising: an elongated, unitary, extruded body which is formed of an elastically resilient material and has a generally U-shaped channel extending lengthwise along the length of the body to define an elongated, narrow binder opening along the open side of the U-shaped channel, and first and second branch members formed of elongated strips of the material from which said elongated, unitary, extruded body is made extending lengthwise along the outside of said generally U-shaped channel, said first and second branch members being attached to said body adjacent said binder opening and extending toward the closed side of said generally U-shaped channel to form respective first and second elongated, narrow cover openings adjacent said closed side of said generally U-shaped channel, said cover openings facing in the opposite direction to that of said binder opening, whereby sheet material is gripped and held in said binder opening and cover sheets are gripped and held in said cover opening stop create a bound document.

7. A document binder as in claim 6 in which the width of each said first and second branch member formed of elongated strips of the material from which said elongated, unitary, extruded body is made is slightly narrower than the sides of the generally U-shaped channel such that cover material inserted in said first and second cover openings, when folded over the document binder and sheet material in said binder opening, presents an appearance similar to the spine of a book.

* * * * *